US009377722B2

(12) United States Patent
Kanai et al.

(10) Patent No.: US 9,377,722 B2
(45) Date of Patent: Jun. 28, 2016

(54) DESTATICIZING DEVICE AND IMAGE FORMING APPARATUS

(71) Applicant: FUJI XEROX CO., LTD., Tokyo (JP)

(72) Inventors: Makoto Kanai, Yokohama (JP); Wataru Yamada, Minamiashigara (JP); Kanji Shintaku, Yokohama (JP); Tomoya Oki, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/693,168

(22) Filed: Apr. 22, 2015

(65) Prior Publication Data

US 2016/0124352 A1 May 5, 2016

(30) Foreign Application Priority Data

Oct. 30, 2014 (JP) ..... 2014-221095
Oct. 30, 2014 (JP) ..... 2014-221096
Oct. 30, 2014 (JP) ..... 2014-221097

(51) Int. Cl.
*G03G 15/16* (2006.01)

(52) U.S. Cl.
CPC ..... *G03G 15/1665* (2013.01)

(58) Field of Classification Search
None
See application file for complete search history.

(56) References Cited

U.S. PATENT DOCUMENTS 7,599,652 B2 10/2009 Takagami
2003/0118359 A1* 6/2003 Ogiyama ..... G03G 15/167 399/45
2006/0198668 A1* 9/2006 Tsujita ..... G03G 15/6532 399/315
2008/0025767 A1 1/2008 Takagami

FOREIGN PATENT DOCUMENTS

JP 63154571 A * 6/1988
JP 2003-261244 A 9/2003
JP 2004-184919 A 7/2004
JP 3608358 B2 1/2005
JP 2005-250033 A 9/2005
JP 2006-276498 A 10/2006
JP 2008-216468 A 9/2008
JP 4770409 B2 9/2011
JP 5220288 B2 6/2013

OTHER PUBLICATIONS

Partial translation of Goto, JP S63-154571 (1988).*

* cited by examiner

*Primary Examiner* — David Gray
*Assistant Examiner* — Sevan A Aydin
(74) *Attorney, Agent, or Firm* — Oliff PLC

(57) ABSTRACT

A destaticizing device includes: a first destaticizing member that is disposed at a downstream side in a conveyance direction of a medium relatively to a transfer area where an image held in a surface of an image holder is transferred to the medium, the first destaticizing member being grounded and destaticizing the medium; and a second destaticizing member that is disposed adjacent to the first destaticizing member with respect to the conveyance direction of the medium, the second destaticizing member being grounded and destaticizing the medium.

14 Claims, 9 Drawing Sheets

FIG. 7

| No. | destaticizing member 1 | | | | | destaticizing member 2 | | | | | destaticizing member 3 | | | | | releasability | image quality |
|---|---|---|---|---|---|---|---|---|---|---|---|---|---|---|---|---|---|
| | material name | maker | resistance value/Ωcm | shape | tip position | material name | maker | resistance value /Ωcm | shape | tip position | material name | maker | resistance value/Ωcm | shape | tip position | | |
| Exp. 1-1 | conductive PE film type R 0.08mm | Tsuchiya Co., Ltd. | 1.E+01 | saw teeth | +1 mm | SUS | | 1.E-05 | saw teeth | -1 mm | | | | | | ○ | ○ |
| Exp. 1-2 | conductive PE film type R 0.08mm | Tsuchiya Co., Ltd. | 1.E+01 | saw teeth | 0 | SUS | | 1.E-05 | saw teeth | 0 | | | | | | ○ | ⊕ |
| Exp. 1-3 | destaticizing brush SA7-F | Kenei Co., Ltd. | 1.E+05 | brush-like | +1 mm | SUS | | 1.E-05 | saw teeth | -1 mm | | | | | | ○ | ⊕ |
| Exp. 1-4 | destaticizing brush TR1-F | Kenei Co., Ltd. | 1.E-01 | brush-like | +1 mm | SUS | | 1.E-05 | saw teeth | -1 mm | | | | | | ⊕ | ⊕ |
| Exp. 1-5 | destaticizing non-woven fabric SP-S2 | Kenei Co., Ltd. | 1.E+03 | plate-like | +1 mm | SUS | | 1.E-05 | saw teeth | -1 mm | | | | | | ⊕ | ○ |
| Exp. 1-6 | destaticizing brush SA7 | Tsuchiya Co., Ltd. | 1.E+02 | brush-like | +1 mm | conductive PE film type R 0.08 mm | Tsuchiya Co., Ltd. | 1.E+01 | saw teeth | 0 | | | | | | ○ | ○ |
| Exp. 1-7 | destaticizing brush TR1-F | Kenei Co., Ltd. | 1.E-01 | brush-like | +1 mm | destaticizing brush TR1-F | Kenei Co., Ltd. | 1.E-01 | brush-like | +1 mm | SUS | Kenei Co., Ltd. | 1.E-05 | saw teeth same as current | -1 mm | ⊕ | ⊕ |
| Exp. 1-8 | SUS | | 1.E-05 | saw teeth | -1 mm | destaticizing brush TR1-F | Kenei Co., Ltd. | 1.E-01 | brush-like | +1 mm | | | | | | ⊕ | ⊕ |
| Comp. 1-1 | SUS | | 1.E-05 | saw teeth | -1 mm | | | | | | | | | | | × | ⊕ |
| Comp. 1-2 | SUS | | 1.E-05 | saw teeth | 0 | | | | | | | | | | | ○ | × |
| Comp. 1-3 | destaticizing brush TR1-F | Kenei Co., Ltd. | 1.E-01 | brush-like | +1 mm | destaticizing brush TR1-F | Kenei Co., Ltd. | 8.E-02 | brush-like | 0 | | | | | | × | ○ |

FIG. 9

| No. | tip position (first destaticizing member) | tip position (second destaticizing member) | paper jam due to poor destaticizing | paper jam due to collision | durability (second destaticizing member) | density unevenness |
|---|---|---|---|---|---|---|
| Exp. 2-1 | -1 mm | 0.5 mm | ⊕ | ⊕ | ⊕ | ⊕ |
| Exp. 2-2 | -1 mm | 1.5 mm | ⊕ | ⊕ | ⊕ | ⊕ |
| Exp. 2-3 | -1 mm | 5 mm | ⊕ | ⊕ | ⊕ | ⊕ |
| Exp. 2-4 | -1 mm | 6 mm | ⊕ | ○ | ○ | ⊕ |
| Comp. 2-1 | -1 mm | - | × | ⊕ | - | ○ |
| Comp. 2-2 | - | 5 mm | × | ⊕ | ⊕ | × |
| Comp. 2-3 | +5 mm | - | ⊕ | × | - | ○ |
| Comp. 2-4 | -1 mm | -1 mm | × | ⊕ | ⊕ | ○ |

DESTATICIZING DEVICE AND IMAGE FORMING APPARATUS

CROSS-REFERENCE TO RELATED APPLICATIONS

This application is based on and claims priority under 35 USC 119 from Japanese Patent Application No. 2014-221095 filed on Oct. 30, 2014, Japanese Patent Application No. 2014-221096 filed on Oct. 30, 2014 and Japanese Patent Application No. 2014-221097 filed on Oct. 30, 2014.

BACKGROUND

Technical Field

The present invention relates to a destaticizing device and an image forming apparatus.

SUMMARY

According to an aspect of the invention, there is provided a destaticizing device including: a first destaticizing member that is disposed at a downstream side in a conveyance direction of a medium relatively to a transfer area where an image held in a surface of an image holder is transferred to the medium, the first destaticizing member being grounded and destaticizing the medium; and a second destaticizing member that is disposed adjacent to the first destaticizing member with respect to the conveyance direction of the medium, the second destaticizing member being grounded and destaticizing the medium.

BRIEF DESCRIPTION OF THE DRAWINGS

Exemplary embodiments of the present invention will be described in detail based on the following figures, wherein:

FIG. 7 is a table of conditions and results of Experiments 1;

FIG. 9 is a table of conditions and results of Experiment 2.

DESCRIPTION OF REFERENCE NUMERALS AND SIGNS

Figure 1:
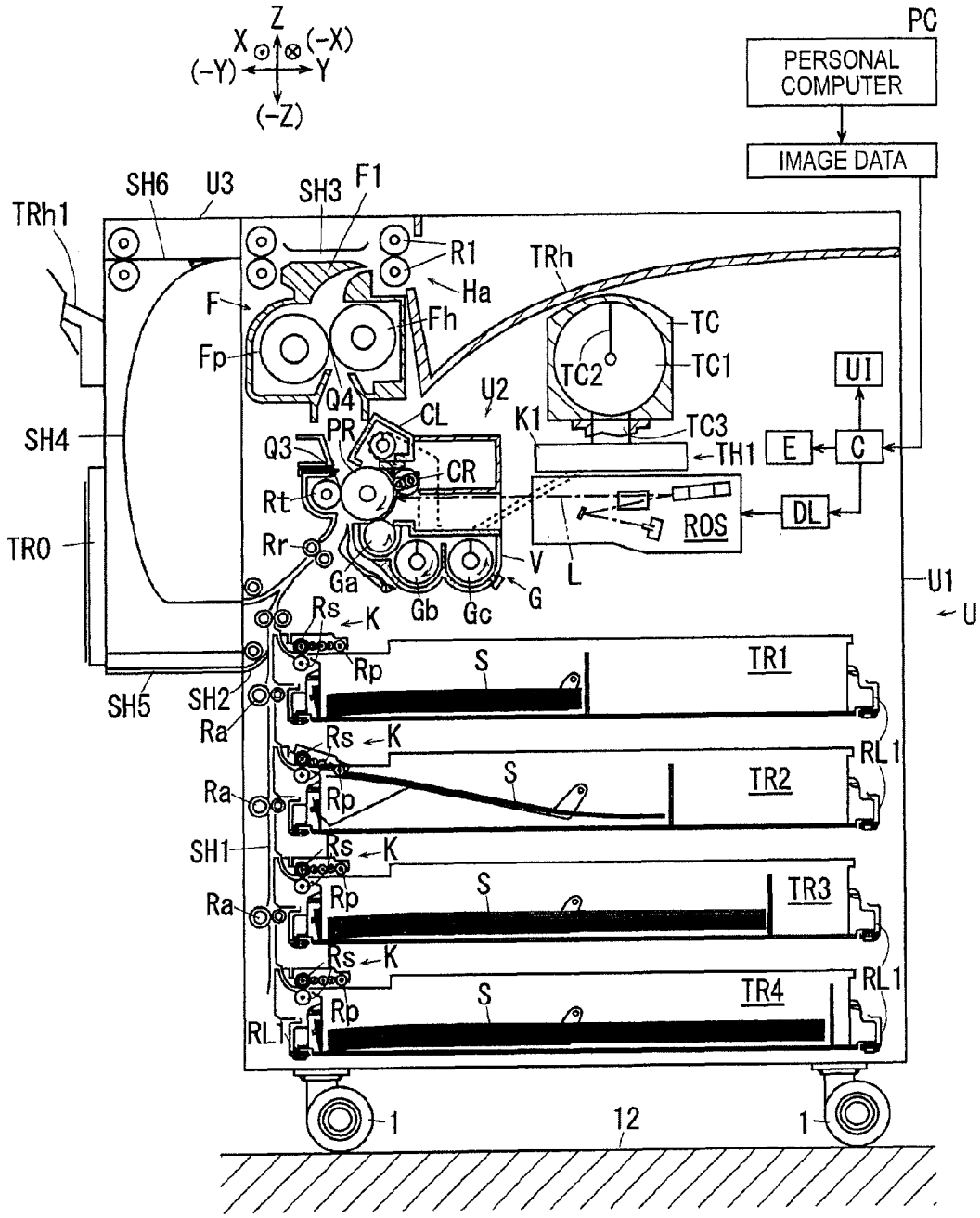
FIG. 1 is an overall explanatory view of an image forming apparatus according to Example 1.

6 . . . first destaticizing member
6*c* . . . grounding portion
6-19 . . . destaticizing device

11 . . . protective member
12 . . . support portion
17 . . . protection portion (guide member)
18-19 . . . second destaticizing member
19 . . . conductive bristle
F . . . fixing device
PR . . . image holder
Q3 . . . transfer area
Rt . . . transfer device
S . . . medium
U . . . image forming apparatus

DETAILED DESCRIPTION

Next, a specific example (hereinafter referred to as Example) of an exemplary embodiment of the invention will be described with reference to the drawings. However, the invention is not limited to the following Example.

Incidentally, in order to make it easy to understand the following description, assume that in the drawings the front/rear direction is an X-axis direction, the left/right direction is a Y-axis direction, and the up/down direction is a Z-axis direction. In addition, assume that directions designated by the arrows X, −X, Y, −Y, Z and −Z are a front direction, a rear direction, a right direction, a left direction, an upper direction and a lower direction or a front side, a rear side, a right side, a left side, an upper side and a lower side.

In addition, an arrow with the dot "." in the circle "○" designates an arrow toward the front of the sheet from the back of the same, and an arrow with the cross "x" in the circle "○" designates an arrow toward the back of the sheet from the front of the same.

Incidentally, in the following description using the drawings, any other members than members required for the description will be omitted from the drawings in order to make it easy to understand the description.

Example 1

FIG. 1 is an overall explanatory view of an image forming apparatus according to Example 1.

In FIG. 1, a printer U as an example of an image forming apparatus according to Example 1 has a printer body U1 as an example of an apparatus body. A first discharge tray TRh as an example of a first medium discharge portion is provided on an upper face of the printer body U1. An operation portion UI is provided in an upper face of a right portion of the printer body U1. The operation portion UI has a not-shown display portion and so on. The operation portion UI is designed so that a user can perform an input operation thereon.

A personal computer PC as an example of an image information transmitting apparatus is electrically connected to the printer U in Example 1.

The printer U has a controller C as an example of a control portion. The controller C can receive electric signals such as image information, control signals, etc. transmitted from the personal computer PC. In addition, the controller C is designed so that the controller can output a control signal to the operation portion UI or an electric circuit E. Further, the controller C is electrically connected to a writing circuit DL.

The writing circuit DL outputs a drive signal to an exposure machine ROS as an example of a writing device in accordance with inputted information. The exposure machine ROS is designed so that the exposure machine can output laser light L as an example of writing light in accordance with the inputted signal.

Figure 2:
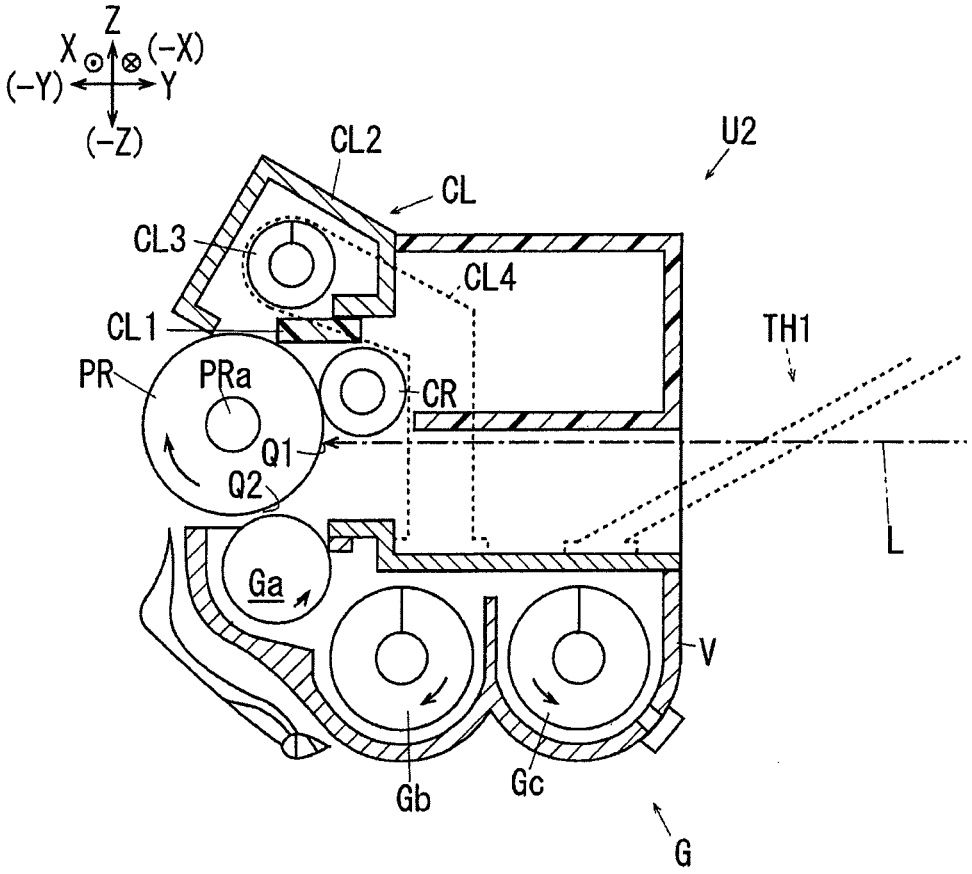
FIG. 2 is a main portion enlarged view of a part of the apparatus where a toner image is formed in FIG. 1.

FIG. 2 is a main portion enlarged view of a part of the apparatus where a toner image is formed in FIG. 1.

In FIG. 1 and FIG. 2, a photoreceptor PR as an example of an image holder is disposed on the left side of the exposure machine ROS. The photoreceptor PR in Example 1 is supported rotatably in the arrow direction around a rotation shaft PRa. The photoreceptor PR is irradiated with the laser light L in a writing area Q1.

Around the photoreceptor PR, a charging roll CR as an example of a charging member, a developing device G, and a photoreceptor cleaner CL as a cleaner for the image holder are disposed along the rotation direction of the photoreceptor PR.

Incidentally, in the printer U in Example 1, the photoreceptor PR, the charging roll CR, the developing device G and the photoreceptor cleaner CL are formed integrally as a removable unit. That is, the photoreceptor PR, the charging roll CR, the developing device G and the photoreceptor cleaner CL are constituted as a process unit U2, which can be removably attached to the printer body U1.

A charging voltage is applied to the charging roll CR from the electric circuit E.

The developing device G has a developing vessel V for internally storing toner as an example of developer. A developing roll Ga as an example of a developer holder is supported rotatably inside the developing vessel V. The developing roll Ga is disposed to be opposed to the photoreceptor PR in a developing area Q2.

In addition, a developing voltage is applied to the developing roll Ga from the power supply circuit E. In addition, augers Gb and Gc as examples of developer conveyance members are supported rotatably inside the developing vessel V.

One end of a supply path of a toner supply device TH1 as an example of a developer supply device fixedly supported in the printer U is connected to the developing vessel V. The other end of the supply path of the toner supply device TH1 is connected to a discharge port TC3 of a toner cartridge TC as an example of a developer storage vessel.

In FIG. 1, the toner cartridge TC has a cartridge body TC1 as an example of a vessel body for internally storing toner. A toner conveyance member TC2 as an example of a developer conveyance member is supported rotatably inside the cartridge body TC1. The toner cartridge TC is designed so that the toner cartridge TC can be detachably inserted to the printer U so as to be removably attached thereto.

A toner image forming device for forming a toner image on the photoreceptor PR is constituted by the photoreceptor PR, the charging roll CR, the exposure machine ROS, the developing device G, and so on.

In FIG. 1, paper feed trays TR1 to TR4 as examples of medium storage portions are provided in a lower portion of the printer U. The paper feed trays TR1 to TR4 store a recording sheet S as examples of media respectively.

In FIG. 1, rails RL1 as examples of vessel guide members are disposed on the opposite left and right sides of each paper feed tray TR1 to TR4. The rails RL1 support left and right opposite end portions of each paper feed tray TR1 to TR4 movably. Accordingly, each paper feed tray TR1 to TR4 is supported by a pair of left and right rails RL1 so that the paper feed tray TR1 to TR4 can be put in/out in the front/rear direction.

In FIG. 1, a paper feeding device K is disposed in a left upper portion of each paper feed tray TR1 to TR4. The paper feeding device K has a pickup roll Rp as an example of a medium pickup member. Separation rolls Rs as examples of separation members are disposed on the left side of the pickup roll Rp. The separation rolls Rs include a feed roll as an example of a medium conveyance member and a retard roll as an example of a medium separation member.

A paper feed path SH1 as an example of a medium conveyance path is disposed on the left side of the paper feed device K. The paper feed path SH1 extends upward. A plurality of conveyance rolls Ra as examples of medium conveyance members are disposed in the paper feed path SH1. A registration roll Rr as an example of a medium conveyance time adjusting member is disposed at an upper end of the paper feed path SH1 that is a downstream end.

In addition, a manual insertion tray TR0 as an example of a manual insertion portion is attached to a left side portion of the printer U. A left end of a manual insertion path SH2 as an example of a manual insertion conveyance path is connected to a right portion of the manual insertion tray TR0. A right end of the manual insertion path SH2 is connected to the paper feed path SH1.

In FIG. 1, a transfer roll Rt as an example of a transfer device is disposed above the registration roll Rr. In a transfer area Q3, the transfer roll Rt is opposed to the photoreceptor PR and brought into contact therewith. Accordingly, the transfer roll Rt in Example 1 is driven and rotated by the rotation of the photoreceptor PR. A transfer voltage is applied to the transfer roll Rt from the power supply circuit E.

The aforementioned photoreceptor cleaner CL is disposed on the downstream side of the transfer roll Rt with respect to the rotation direction of the photoreceptor PR. The photoreceptor cleaner CL has a cleaning blade CL1 as an example of a cleaning member. The cleaning blade CL1 is formed into a plate-like shape. The cleaning blade CL1 touches the photoreceptor PR in its one end portion.

A cleaner vessel CL2 as an example of a cleaning vessel is disposed above the cleaning blade CL1. The cleaning blade CL1 is supported on the cleaner vessel CL2. A space in which developer can be received is formed inside the cleaner vessel CL2. A recovery auger CL3 as an example of a developer conveyance member is supported rotatably inside the cleaner vessel CL2. In addition, a recovery path CL4 as an example of a developer conveyance path is supported in a front end portion of the cleaner vessel CL2. The recovery path CL4 extends from the photoreceptor cleaner CL to the developing device G.

In FIG. 1, a fixing device F is supported above the transfer roll Rt. The fixing device F has a heating roll Fh as an example of a heat-fixing member and a pressure roll as an example of a pressure-fixing member. The heating roll Fh and the pressure roll Fp are in contact with each other in a fixing area Q4. The heating roll Fh rotates due to a driving force transmitted thereto from a not-shown driving source. In addition, an electric power for heating a not-shown heater is supplied to the heating roll Fh from the electric circuit E.

An image recording portion U2+Rt+F for recording an image on a sheet S is constituted by the process unit U2, the transfer roll Rt and the fixing device F.

A sheet guide F1 as an example of a medium guide portion is formed above the fixing device F. A paper discharge roll R1 as an example of a medium discharge member is disposed on the right side of the sheet guide F1. A medium discharge port Ha is formed on the right side of the paper discharge roll R1. The first discharge tray TRh is disposed under the medium discharge port.

In FIG. 1, a connection path SH3 as an example of a medium conveyance path is disposed above the fixing device F and on the left side of the paper discharge roll R1. The connection path SH3 extends to the left from the discharge port Ha.

A reversing unit U3 as an example of a medium reversing device is supported on a left side face of the printer body U1 and above the manual insertion tray TR0. A reversing path SH4 as an example of a medium conveyance path is formed inside the reversing unit U3. An upper end of the reversing path SH4 is connected to a left end of the connection path SH3. A lower end of the reversing path SH4 joins the paper feed path SH1 on the upstream side of the registration roll Rr.

In addition, a second discharge path SH6 as an example of a medium conveyance path is formed in an upper portion of the reversing unit U3. A right end of the second discharge path SH6 is connected to the connection path SH3, and branched from the reversing path SH4. A left end of the second discharge path SH6 extends to a left side face of the reversing unit U3. A face-up tray TRh1 as an example of a second discharge portion is supported on the left side face of the reversing unit U3. Accordingly, in this configuration, a sheet S passing through the second discharge path SH6 can be discharged to the face-up tray TRh1.

(Function of Image Forming Apparatus)

In the printer U according to Example 1, which has the aforementioned configuration, image information transmitted from the personal computer PC is inputted to the controller C. The controller C converts the inputted image information into information for forming a latent image at a predetermined timing, and outputs the information to the writing circuit DL. The exposure machine ROS outputs laser light L based on a signal received by the writing circuit DL. Incidentally, the controller C controls the operation of the operation portion UI, the writing circuit DL, the power supply circuit E, etc.

In FIG. 1 and FIG. 2, the surface of the photoreceptor PR is charged by the charging roll CR to which a charging voltage is applied. The surface of the photoreceptor PR charged by the charging roll CR is exposed to the laser light L of the exposure machine ROS and scanned therewith in the writing area Q1. Thus, an electrostatic latent image is formed. The surface of the photoreceptor PR where the electrostatic latent image has been formed passes the developing area Q2 and the transfer area Q3 sequentially.

In the developing area Q2, the developing roll Ga is opposed to the photoreceptor PR. The developing roll Ga rotates holding developer inside the developing vessel V on the surface of the developing roll Ga. Thus, due to a toner image held on the surface of the developing roll Ga, the electrostatic latent image in the surface of the photoreceptor PR is developed into a toner image as an example of a visible image. The developer inside the developing vessel V is stirred and circulated by the augers Gb and Gc.

When the developer inside the developing vessel V is consumed with development in the developing roll Ga, developer is supplied from the toner cartridge TC. That is, the toner conveyance member TC2 is driven and rotated to convey toner in the cartridge body TC1 to the discharge port TC3 in accordance with the consumption of the developer. The toner discharged from the discharge port TC3 is conveyed to the developing vessel V by a not-shown toner supply/conveyance member in a supply path of the cartridge toner supply device TH1.

Sheets S for recording images are stored in the paper feed trays TR1 to TR4. Sheet S stored in each paper feed tray TR1 to TR4 are picked up by the pickup roll Rp of the paper feeding device K. The sheets S picked up by the pickup roll Rp are separated one by one by the separation rolls Rs. Each sheet S separated by the separation rolls Rs is supplied into the paper feed path SH1. The sheet S in the paper feed path SH1 is conveyed toward the registration roll Rr by the conveyance rolls Ra.

Incidentally, a sheet S supplied from the manual insertion tray TR0 is conveyed to the registration roll Rr through the manual insertion path SH2. The sheet S conveyed to the registration roll Rr is conveyed to the transfer area Q3 by the registration roll Rr in accordance with the time when the toner image in the surface of the photoreceptor PR moves to the transfer area Q3.

In the transfer area Q3, the toner image on the surface of the photoreceptor PR is transferred to the sheet S passing the transfer area Q3 by the transfer roll Rt to which the transfer voltage is applied.

In FIG. 2, toner adhering to the surface of the photoreceptor PR that has passed through the transfer area Q3 is removed by the cleaning blade CL1. Thus, the photoreceptor PR is cleaned up. The toner removed by the cleaning blade CL1 is recovered by the cleaner vessel CL2. The toner recovered by the cleaner vessel CL2 is conveyed by the recovery auger CL3. The toner conveyed by the recovery auger CL3 is put back into the developing vessel V through the recovery path CL4. That is, the developer recovered by the photoreceptor cleaner CL is reused in the developing device G.

The photoreceptor PR whose surface has been cleaned by the photoreceptor cleaner CL is charged again by the charging roll CR.

The sheet S to which the toner image has been transferred in the transfer area Q3 is conveyed to the fixing area Q4 of the fixing device F in the state where the toner image has not been fixed yet.

In the fixing area Q4, the sheet S is put between the heating roll Fh and the pressure roll Fp. Thus, the toner image is heated and fixed.

The sheet S at which the toner image has been fixed by the fixing device F is guided by the sheet guide F1 and conveyed to the paper discharge roll R1. When the sheet S is discharged to the first discharge tray TRh, the sheet S sent to the paper discharge roll R1 is discharged to the first discharge tray TRh through the discharge port Ha.

For double-sided printing, the discharge roll R1 rotates reversely as soon as a conveyance-direction rear end of the sheet S at which an image has been recorded at the first surface thereof passes the sheet guide F1. Accordingly, the sheet S is conveyed to the reversing path SH4 through the connection path SH3. The sheet S conveyed to the reversing path SH4 is conveyed to the registration roll Rr in the state where the sheet S has been turned inside out. Thus, the sheet S is sent again to the transfer area Q3 through the registration roll Rr, and an image is recorded on the second surface of the sheet S.

When the sheet S is discharged to the face-up tray TRh1, the sheet S conveyed to the connection path SH3 by the reverse rotation of the paper discharge roll R1 is conveyed to the second discharge path SH6. Then the sheet S conveyed to the second discharge path SH6 is discharged to the face-up tray TRh1.

(Description of Separation Device)

Figure 3:
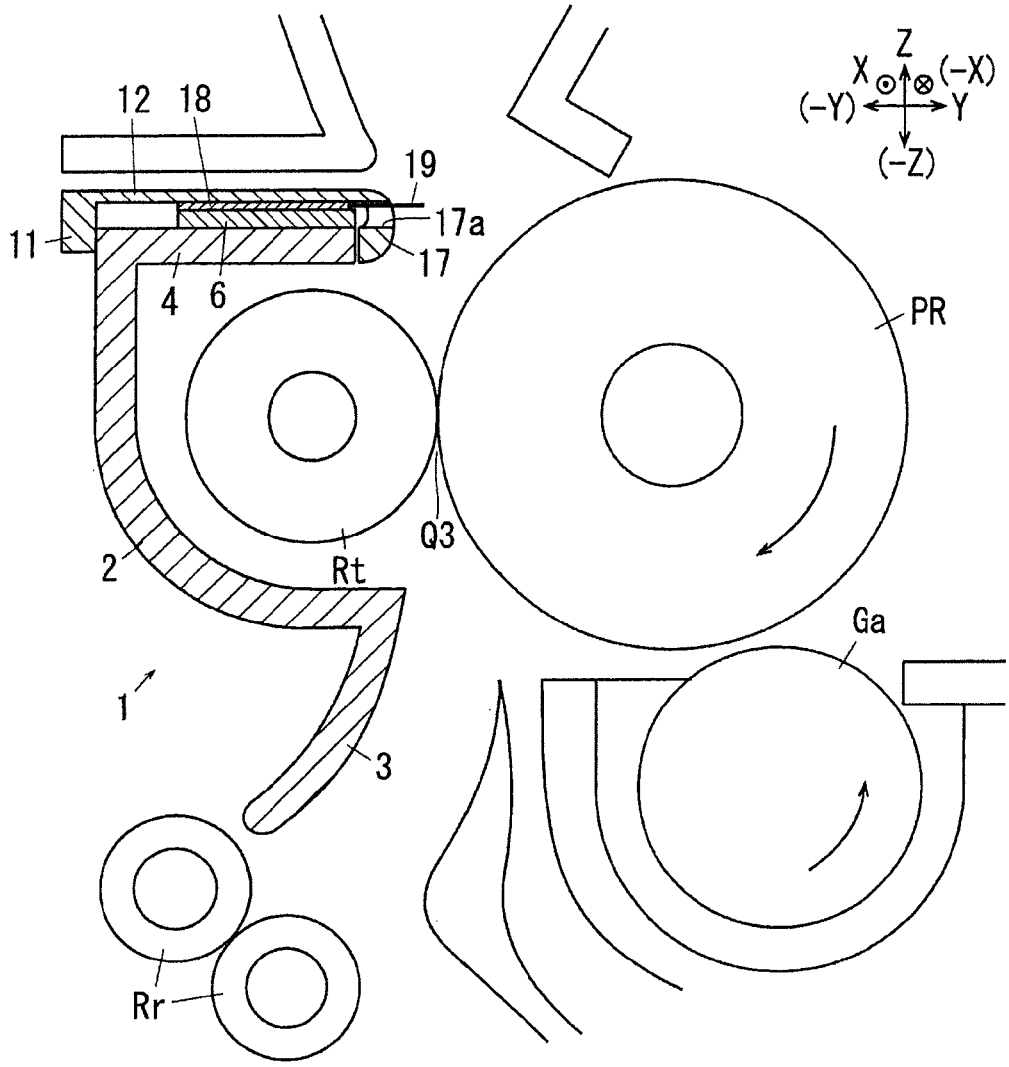
FIG. 3 is an enlarged view of a part around a transfer area in Example 1.

FIG. 3 is an enlarged view of a part around the transfer area in Example 1.

Figure 4A:
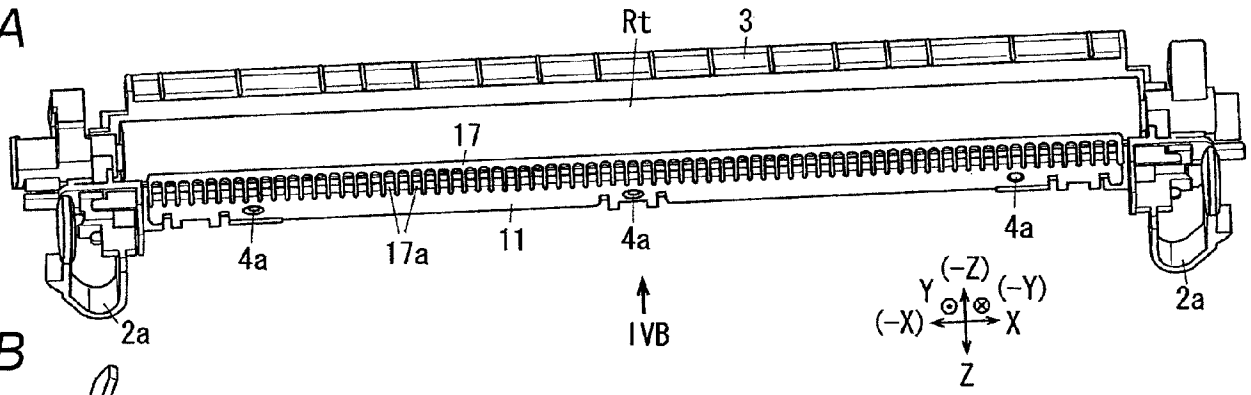
FIG. 4A is an explanatory view of a separation device as an example of a destaticizing device in Example 1, which is a perspective view.
Figure 4B:
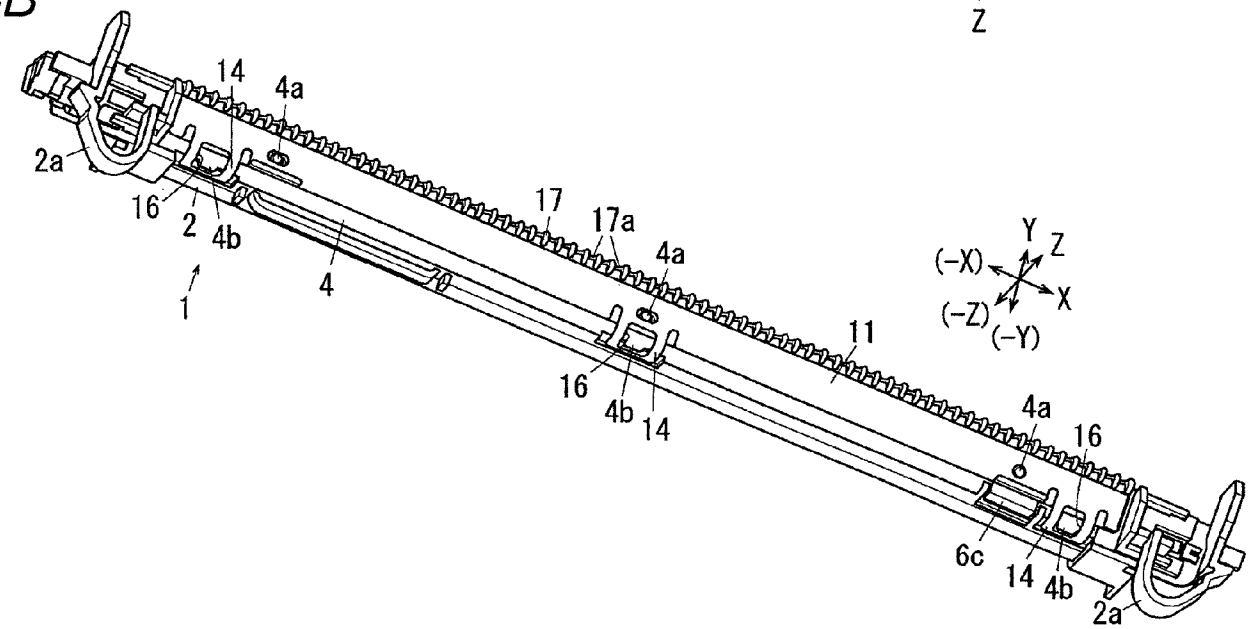
FIG. 4B is an explanatory view of a separation device as an example of a destaticizing device in Example 1, which is a view of the device observed from an arrow IVB direction in FIG. 4A.

FIGS. 4A and 4B are explanatory views of a separation device as an example of a destaticizing device in Example 1. FIG. 4A is a perspective view, and FIG. 4B is a view of the destaticizing device observed in the direction of the arrow IVB in FIG. 4A.

In FIG. 2, FIG. 3 and FIGS. 4A and 4B, in the printer U in Example 1, the transfer unit 1 having the transfer roll Rt is removably supported on the printer body U1. The transfer unit 1 has a housing 2 as an example of a frame. The housing 2 supports the opposite front and rear ends of the transfer roll Rt rotatably. Grip portions 2*a* that can be gripped by a worker when the worker handles the transfer unit 1 are supported on the opposite front and rear end portions of the housing 2.

An upstream guide 3 extending upstream in the conveyance direction of the sheet S is formed integrally with the housing 2. Due to the upstream guide 3, the sheet S conveyed from the registration roll Rr is guided to the transfer area Q3.

Figure 5:
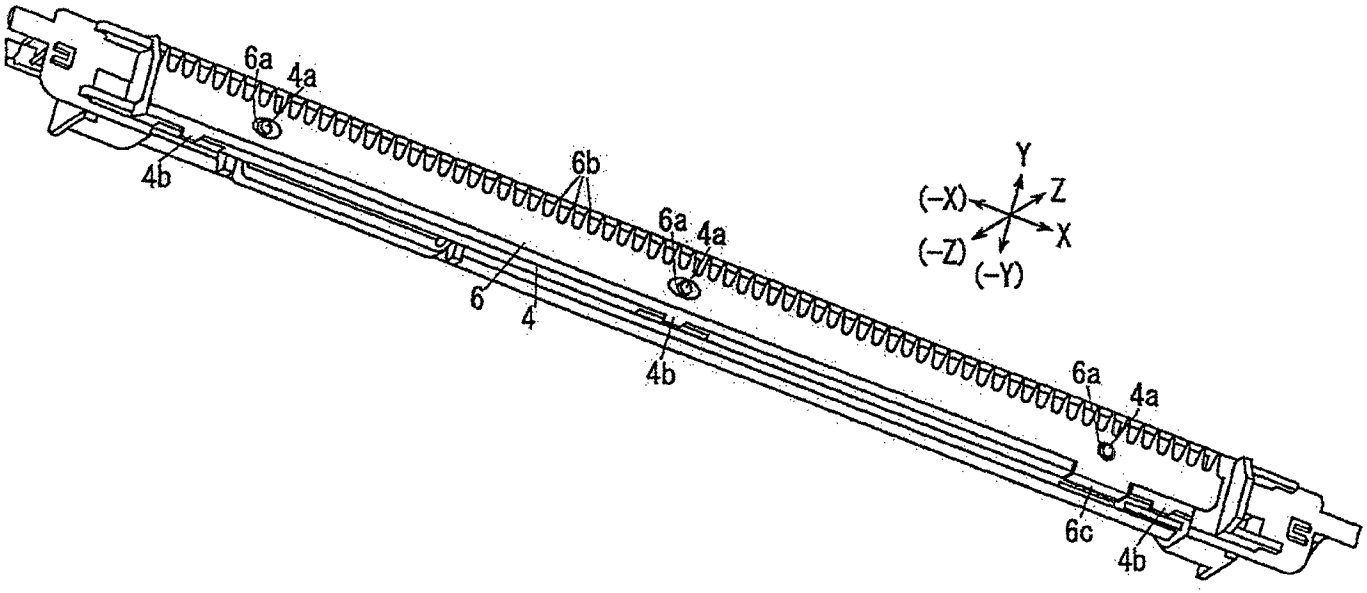
FIG. 5 is an exploded view of the separation device in Example 1, which is an explanatory view of a part including a first destaticizing member.

FIG. 5 is an exploded view of the separation device in Example 1, which is an explanatory view of a part including a first destaticizing member.

In FIG. 3, FIGS. 4A and 4B and FIG. 5, an erected wall 4 as an example of a support portion is formed on the downstream side in the conveyance direction of the sheet S relatively to the transfer roll Rt. Protrusions 4*a* as examples of positioning portions are formed in the left/right-direction center portion of the erected wall 4. The protrusions 4*a* are disposed in three places and at intervals in the front/rear direction. In addition, claw portions 4*b* as examples of attachment portions are formed on the left side of the erected wall 4, that is, on the side far from the sheet S. The claw portions 4*b* are formed like protrusions protruding to the left. The claw portions 4*b* are disposed in three places and at intervals in the front/rear direction.

Figure 6:
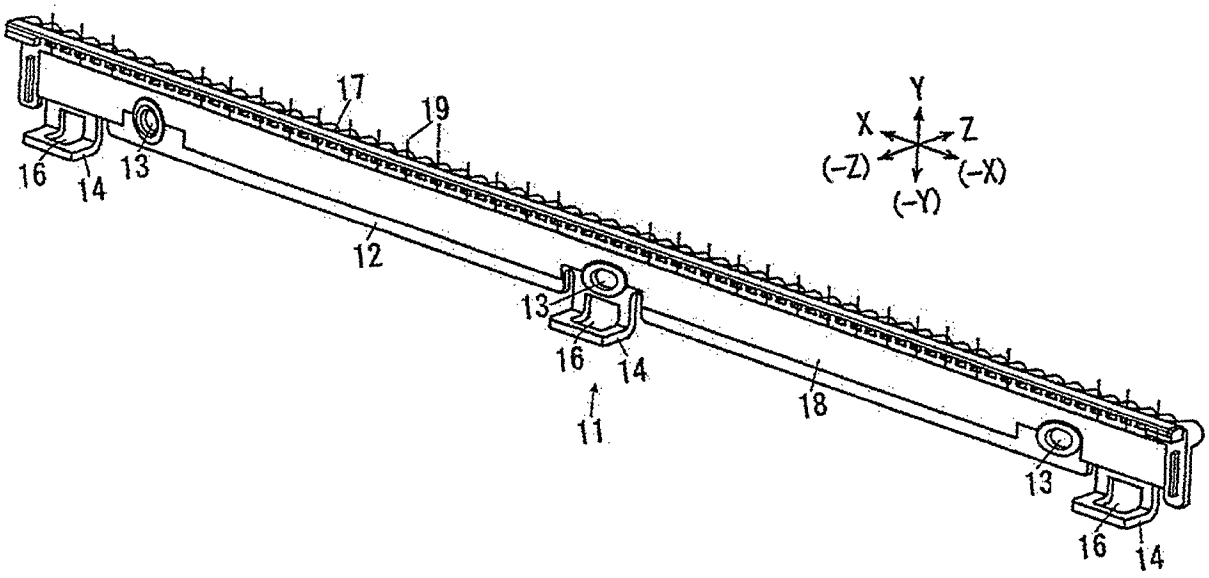
FIG. 6 is an exploded view of the separation device in Example 1, which is an explanatory view of a part including a second destaticizing member.

FIG. 6 is an exploded view of the separation device in Example 1, which is an explanatory view of a part including a second destaticizing member.

In FIG. 3, a Detack saw 6 as an example of a first destaticizing member is supported on a top face of the erected wall 4, that is, on a downstream face in the conveyance direction of the sheet S. In FIG. 3 and FIG. 6, the Detack saw 6 in Example 1 consists of a conductive plate extending in the front/rear direction and the left/right direction. The Detack saw 6 in Example 1 consists of a metal plate made from SUS by way of example. Three hole portions 6*a* are formed in a center portion of the Detack saw 6 in the left/right direction and in positions corresponding to the protrusions 4*a*. The three hole portions 6*a* are formed into a round hole shape, a long hole shape and a long hole shape respectively in order from the front. When the protrusions 4*a* formed on the erected wall 4 penetrate the hole portions 6*a* respectively, the Detack saw 6 is positioned and supported on the housing 2.

A right end of the Detack saw 6, that is, an end portion 6*b* on the conveyed sheet S side is formed into a saw-toothed shape. In Example 1, the end portion 6*b* is formed to have triangular saw teeth whose tips are arranged at predetermined intervals.

A grounding portion 6*c* is formed in a front end portion at the left end of the Detack saw 6. The grounding portion 6*c* is formed into a shape in which the metal plate is bent downward. The grounding portion 6*c* touches a not-shown conductive member provided in the printer body U1. The conductive member is grounded or earthed.

In FIG. 3, FIGS. 4A and 4B, and FIG. 5, a downstream cover 11 as an example of a protective member is removably supported above the erected wall 4. The downstream cover 11 has a plate-like body portion 12 extending in the front/rear direction and the left/right direction. In the body portion 12, hole portions 13 are formed in positions corresponding to the protrusions 4*a*. The hole portions 13 are formed into a round hole shape, a long hole shape and a long hole shape respectively in order from the front, in the same manner as the hole portions 6*a* of the Detack saw 6. Thus, when the protrusions 4*a* penetrate the hole portions 13 respectively, the downstream cover 11 is positioned on the housing 2.

At the left end of the body portion 12, three mounted portions 14 are formed correspondingly to the positions of the claw portions 4*b*. Each mounted portion 14 is formed into a shape bent downward. Opening portions 16 the claw portions 4*b* can penetrate are formed in the mounted portions 14 respectively. Thus, when the claw portions 4*b* are hooked on the opening portions 16, the downstream cover 11 can be removably supported on the housing 2.

At the right end of the downstream cover 11, a downstream guide 17 as an example of a protective member and as an example of a guide member is formed. The downstream guide 17 is formed into a shape bent downward. The downstream guide 17 in Example 1 is formed so that the downstream guide 17 can be disposed on the right side of the right end of the Detack saw 6 when the downstream cover 11 is mounted on the housing 2, as shown in FIG. 3. That is, the downstream guide 17 is designed not to expose the Detack saw 6 to the outside but to protect the Detach saw 6, while the sheet S can be guided by the right surface of the downstream guide 17, that is, the external surface of the downstream guide 17. Incidentally, in Example 1, the distance between the external surface of the downstream guide 17 and each tooth tip of the Detack saw 6 is set at 1 mm by way of example.

In the downstream guide 17 in Example 1, openings 17*a* are formed in positions corresponding to the tooth tips of the Detach saw 6.

An aluminum tape 18 extending in the front/rear direction as an example of a connection member is disposed in the lower surface of the body portion 12. In the aluminum tape 18 in Example 1, one side of an aluminum thin film as an example of conductive metal is coated with a bonding agent and pasted to the body portion 12. In addition, the aluminum tape 18 is designed so that the aluminum tape 18 can be touched by the Detack saw 6 when the downstream cover 11 is mounted on the housing 2. Thus, in this state, the aluminum tape 18 and the Detack saw 6 are electrically connected to each other so that the aluminum tape 18 can be also connected to the earth.

Base end portions of bristle bundles 19 are supported on the aluminum tape 18. That is, the base end portions of the bristle bundles 19 are supported to be put between the aluminum tape 18 and the lower surface of the body portion 12. In addition, each bristle bundle 19 in Example 1 consists of a bundle of a plurality of conductive bristles. Incidentally, in Example 1, due to a material used for the bristle bundle 19, the volume resistivity of the bristle bundle 19 is at least one digit higher than the volume resistivity of the Detack saw 6. In Example 1, SUS with a volume resistivity of $1.0\times10^{-5}$ [Ωcm] is used for the Detack saw 6, and a brush with a volume resistivity of $1.0\times10^{-1}$ [Ωcm] is used as the bristle bundle 19.

In addition, the bristle bundles 19 in Example 1 are disposed in a plurality of places and at intervals in the front/rear direction. In Example 1, the bristle bundles 19 are disposed at intervals twice as long as the intervals among the tooth tips of the Detack saw 6. That is, the bristle bundles 19 are disposed for every second positions corresponding to the tooth tips in the front/rear direction.

In addition, the bristle bundles 19 in Example 1 are set to be so long that their tips can penetrate the openings 17*a* and protrude to the outside of the downstream guide 17, that is, toward the sheet S. In Example 1, the length with which the tip of each bristle bundle 19 protrudes from the external surface of the downstream guide 17 is set at 1 mm by way of example.

Incidentally, each bristle bundle 19 in Example 1 is made from a material which is rigid enough to prevent the tip of the bristle bundle 19 from being hung down and to keep the bristle bundle 19 in a linear self-standing posture, but which can be elastically deformed when the bristle bundle 19 touches the sheet S.

A destaticizing brush 18-19 as an example of a second destaticizing member in Example 1 is constituted by the aluminum tape 18 and the bristle bundles 19. In addition, a sheet separation device 6-19 as an example of a destaticizing device in Example 1 is constituted by the Detack saw 6, the downstream cover 11, the destaticizing brush 18-19, etc.

(Function of Sheet Separation Device)

In the sheet separation device 6-19 in Example 1, which is provided with the aforementioned configuration, the sheet S to which a toner image has been transferred is destaticized from the back side of the sheet S. When the sheet S is destaticized down to required potential, the sheet S can be separated from the photoreceptor PR. Incidentally, when the destaticizing is insufficient, there is a fear that the sheet S may be attracted by the photoreceptor PR and wound thereon.

A claw for separating the sheet S from the photoreceptor PR may be provided. However, when sufficient separation performance is given to the claw, there is a problem that the photoreceptor PR may be damaged or the number of components may increase to increase the manufacturing cost. In addition, when the printer U is miniaturized, the space is restricted. Thus, there is a case where a place where the claw can be disposed cannot be secured.

Here, in a configuration in which a voltage for cancelling charges is applied to destaticize the sheet S as described in JP-A-2008-216468, JP-A-2003-261244, Japanese Patent No. 3608358, Japanese Patent No. 4770409 or Japanese Patent No. 5220288, it is necessary to place a power supply for applying the voltage. Accordingly, in such a configuration, the configuration for destaticizing the sheet becomes larger in size, and the manufacturing cost or the power consumption increases, so that it is not possible to support the miniaturization of the printer U or the cost reduction of the same. In addition, when the applied voltage is excessive, sudden destaticizing, excessive destaticizing or charging with reversed polarity may occur. Thus, there is another problem that an image that has not been fixed yet may be disturbed to provide an adverse effect on the image quality. In order control the applied voltage within a suitable range, a sensor must be provided, resulting in easy increase in cost.

In order to support the miniaturization of a sheet separation device and the cost reduction of the same, there has been known a configuration in which a power supply is not placed but a destaticizing member is grounded to destaticize a sheet S as in JP-A-2004-184919, JP-A-2005-250033 or JP-A-2006-276498. Here, when the sheet S is a rigid or firm sheet such as plain paper or thick paper, a force to separate the sheet S from the photoreceptor PR with a curvature also acts on the photoreceptor PR due to the firmness of the sheet S. Thus, the sheet S can be separated even by the destaticizing member that is grounded. However, when the sheet S is a sheet with low rigid or low firmness such as thin paper, the sheet S is weak in force to separate itself from the photoreceptor PR. As a result, destaticizing the sheet S may be insufficient when the destaticizing is performed with a single destaticizing portion as in the technique disclosed in JP-A-2004-184919. Accordingly, there is a fear that the sheet S may be wound on the photoreceptor PR, resulting in paper jam.

On the other hand, in the sheet separation device 6-19 in Example 1, the Detack saw 6 and the destaticizing brush 18-19 are grounded while no power supply unit is provided for supplying electric power for destaticizing. Therefore, in the sheet separation device 6-19 in Example 1, the number of components is reduced so that miniaturization and cost reduction can be attained, as compared with a configuration in which a claw for separation or a power supply unit is provided.

In addition, in the sheet separation device 6-19 in Example 1, destaticizing is performed by the Detack saw 6 on the upstream side and the destaticizing brush 18-19 on the downstream side with respect to the conveyance direction of the sheet S. Accordingly, poor separation caused by insufficient destaticizing can be reduced, as compared with the background art such as JP-A-2004-184919 in which destaticizing is performed with a single destaticizing member.

In addition, generally, when a destaticizing member is made to approach or touch the sheet S, the destaticizing performance can be improved. However, when a Detack saw is brought into contact with the sheet S, the front end of the sheet S may collide with the Detack saw to cause paper jam. In addition, when the Detack saw is brought into contact with the sheet S or a destaticizing member made from cloth is brought into contact with the sheet S as in JP-A-2004-184919 or the like, the destaticizing member rubs the back side of the sheet S so that paper jam may occur due to conveyance resistance or scratches may occur.

On the other hand, in Example 1, the Detack saw 6 destaticizes the sheet S inside the downstream guide 17 and in a non-contact manner, while the destaticizing brush 18-19 destaticizes the sheet S outside the downstream guide 17 and in touch with the sheet S or at a closer distance to the sheet S than the Detack saw 6. Accordingly, the Detack saw 6 is prevented from touching the sheet S to cause paper jam. In addition, the destaticizing brush 18-19 is designed to be elastically deformable. Even when the destaticizing brush 18-19 touches the sheet S, conveyance resistance or occurrence of scratches can be reduced.

In addition, when the sheet S is not firm, the sheet S is easily attracted by the photoreceptor PR, and the sheet S is apt to pass through a position farther from the downstream guide 17 than plain paper or thick paper. Accordingly, in a background-art configuration such as JP-A-2004-184919 or in a configuration of only the Detack saw 6, the distance between the sheet S and the destaticizing member may increase to lower the destaticizing performance. That is, poor separation caused by insufficient destaticizing may occur easily.

On the other hand, in Example 1, the destaticizing brush 18-19 enters the conveyance path more deeply than the downstream guide 17. Accordingly, even when the sheet S that is not firm is attracted by the photoreceptor PR and passes through a position far from the downstream guide 17, the tip of the destaticizing brush 18-19 can touch or approach the sheet S. Thus, the destaticizing performance can be kept easily to reduce insufficient destaticizing on the sheet S, as compared with the background-art configuration.

Incidentally, a weak force to separate the sheet S from the photoreceptor PR acts thereon even when the sheet S is not firm. As a result, when destaticizing is performed with the destaticizing brush 18-19, the sheet S can leave the photoreceptor PR due to its low firmness and approach the downstream guide 17, so that destaticizing in the Detack saw 6 can be made effective. Accordingly, poor separation can be reduce due to stepwise destaticizing with the two destaticizing members 6 and 18-19, as compared with destaticizing with a single destaticizing member.

In addition, in a configuration in which a cloth-like member touches the sheet S all over the width range of the sheet S as in a background-art configuration such as JP-A-2004-184919, not only is there a problem that paper jam may occur easily due to increase in conveyance resistance of the sheet S but there is also a problem that the sheet S may be destaticized excessively. That is, when destaticizing is performed all over the range, only a part in touch with the destaticizing member is destaticized to increase a potential difference between the part and an upstream adjacent part the destaticizing member will touch from now on. Accordingly, an image that has been transferred to the surface of the sheet S but has not been fixed yet moves due to influence of an electric field generated thus, so that the image may be disturbed.

On the other hand, in Example 1, the bristle bundles 19 of the destaticizing brush 18-19 are disposed at intervals twice as long as the intervals of the tooth tips of the Detack saw 6. That is, destaticizing is performed more sparsely than in the background-art configuration in which the destaticizing member touches the sheet S all over the range. Thus, in Example 1, the conveyance performance is not deteriorated but excessive destaticizing is also suppressed to suppress the deterioration of the image quality, as compared with the background art.

Consider that a cloth processed like saw teeth as the Detack saw 6 might be used in the background-art configuration such as JP-A-2004-184919. In this case, however, destaticizing might be performed intensively in tooth tip portions to thereby increase the potential difference between each tooth tip portion and its periphery. Thus, an image that has not been fixed yet might be disturbed to degrade the image quality.

On the other hand, in Example 1, the bristle bundles 19 consisting of bundles of a plurality of conductive fibers are used. Accordingly, when the tip portion of each bristle bundle 19 touches the sheet S, the tip of the bristle bundle 19 is loosened and spread so that destaticizing can be performed in a wider range than in the configuration of a tooth end. Thus, the deterioration of the image quality can be reduced in Example 1, as compared with the background-art configuration in which destaticizing is performed intensively.

In addition, in the background-art configuration such as JP-A-2004-184919 or JP-A-2006-276498, a destaticizing member made from cloth touches the sheet S repeatedly. Thus, a problem arises in the durability of the destaticizing member due to abrasion thereof. In addition, in the configuration in which a spacer is used as in JP-A-2005-250033, the destaticizing member does not touch the sheet S, but there is a problem that the destaticizing performance may be lowered.

On the other hand, in Example 1, the Detack saw 6 does not touch the sheet S, but the lowering of durability can be suppressed. In addition, in Example 1, the downstream cover 11 is removably supported on the housing 2. Therefore, if the destaticizing brush 18-19 exhausts its own life-span, only the destaticizing brush can be replaced easily.

Further in the sheet separation device 6-19 in Example 1, the aluminum tape 18 touching the Detack saw 6 is grounded. If the Detack saw 6 and the destaticizing brush 18-19 were grounded individually, it would be necessary to prepare two grounding contact portions on the printer body U1 side, causing a problem that the number of components would increase. In addition, due to looseness of the transfer unit 1 or the like, there might be a fear that one of the two could not be grounded. On the other hand, in Example 1, they are electrically connected to the printer body U1 through the single grounding portion 6*c*. Thus, it is possible to solve the problem that the number of components increases and the problem that one of the two is not grounded.

(Experiments 1)

Next, description will be made about experiments as to the relationship among resistance values of a destaticizing member on the upstream side and a destaticizing member on the downstream side, releasability of sheets S and image quality.

Experiments 1 were evaluated under an environment of 10° C. and 13% RH using DocuPrint P450 made by Fuji Xerox Co., Ltd. That is, Experiments 1 were performed under a low-temperature and low-humidity environment in which sheets S could be easily attracted by an image holder.

An A3-size sheet made by Fuji Xerox Co., Ltd. was cut into A4-size sheets, which were used as sheets S as an example of short grain paper that is so low in firmness as to cause paper jam easily. Incidentally, generally, commercially available fixed paper has pulp fibers extending in the left/right direction when it is long from side to side. Thus, in short side feed or so-called SEF (Short Edge Feed), fibers extend along the conveyance direction and in a so-called long grain state. In this state, the rigidity of the fibers arranged in the conveyance direction acts against the sheet S that will be bent and wound around the photoreceptor PR. Thus, the firmness of the sheet S is apt to increase. On the contrary, in long side feed or so-called LEF (Long Edge Feed), fibers extend along the width direction and in a so-called short grain state. In this state, the rigidity of the fibers hardly acts but the firmness of the sheet S is apt to decrease.

In Experiments 1, an image whose density was about 1% was used for evaluating the releasability of sheets S. The releasability of sheets S was evaluated by the number of sheets in which paper jam occurred when 1,000 sheets were fed. An evaluation of "⊕" was given when the number of sheets in which paper jam occurred was zero. An evaluation of "○" was given when the number of sheets in which paper jam occurred was not smaller than one but smaller than five. An evaluation of "x" was given when the number of sheets in which paper jam occurred was not smaller than five but smaller than twenty.

In addition, in Experiments 1, in order to evaluate the image quality, an image whose density was 30% in 1,200 dpi was printed, and the image quality was evaluated by black stripes appearing in the printed image. An image quality evaluation of "⊕" was given when no black stripe occurred. An image quality evaluation of "○" was given when the number of black stripes not longer than 5 mm was not larger than ten. An image quality evaluation of "Δ" was given when the number of black stripes not longer than 5 mm was in a range of from ten to twenty or when the number of black stripes not shorter than 5 mm was not smaller than one but smaller than five. An image quality evaluation of "x" was given when the number of black stripes not longer than 5 mm was not smaller than twenty or when the number of black stripes not shorter than 5 mm was not smaller than five.

FIG. 7 shows a table of conditions and results of Experiments 1.

Figure 8:
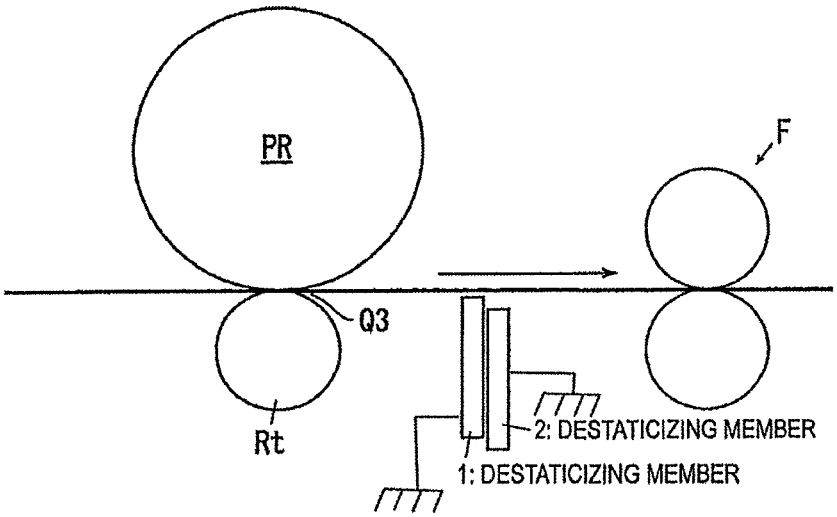
FIG. 8 is an explanatory view of a distal end position in Experiments 1.

FIG. 8 is an explanatory view of a tip position in Experiments 1.

(Experiment 1-1)

In FIG. 7, in Experiment 1-1, "conductive PE film type R 0.08 mm" made by Tsuchiya Co., Ltd. was used as a destaticizing member on the upstream side differently from the configuration of Example 1. On the other hand, a metal plate of SUS304 was used as a destaticizing member on the downstream side. Incidentally, as the destaticizing member on the upstream side, the conductive PE film that was a conductive thin film was processed into a saw-toothed shape similar to a Detack saw. The volume resistivity of the destaticizing member on the upstream side was $1.0\times10^{1}$ [Ωcm]. On the other hand, the volume resistivity of the destaticizing member on the downstream side was $1.0\times10^{-5}$ [Ωcm].

In FIG. 7, in Experiment 1-1, the tip position of the destaticizing member on the upstream side was set at a position of +1 mm when "+" designates a direction approaching the photoreceptor with respect to the tangent direction of the transfer area Q3 and "−" designates a direction leaving the photoreceptor likewise. On the other hand, the tip position of the destaticizing member on the downstream side was set at a position of −1 mm.

(Experiment 1-2)

Experiment 1-2 was configured in the same manner as Experiment 1-1, except that the tip position of each destaticizing member was set at a position of 0 mm.

(Experiment 1-3)

In Experiment 1-3, a destaticizing brush SA7-F made by Kenei Co., Ltd. was used as a destaticizing member on the upstream side, and a destaticizing member on the downstream side was configured in the same manner as in Experiment 1-1. Incidentally, in Experiment 1-3, the volume resistivity of the destaticizing member on the upstream side was $1.0\times10^{+5}$ [Ωcm]. In addition, in Experiment 1-3, the destaticizing brush on the upstream side was configured in the same manner as in Example 1, so that the tip of each bristle bundle was set at a position of +1 mm.

(Experiment 1-4)

Experiment 1-4 was configured in the same manner as Experiment 1-3, except that a destaticizing brush TR1-F made by Kenei Co., Ltd. was used as a destaticizing member on the upstream side. Incidentally, in Experiment 1-4, the volume resistivity of the destaticizing member on the upstream side was $1.0\times10^{-1}$ [Ωcm].

(Experiment 1-5)

Experiment 1-5 was configured in the same manner as Experiment 1-1, except that destaticizing non-woven fabric SP-S2 made by Kenei Co., Ltd. was used as a destaticizing member on the upstream side. Incidentally, in Experiment 1-5, the volume resistivity of the destaticizing member on the upstream side was $1.0\times10^{+3}$ [Ωcm]. In addition, in Experiment 1-5, the destaticizing member on the upstream side was configured not in a saw-toothed shape as in Experiment 1-1 but as it could touch the sheet S all over the surface in the width direction.

(Experiment 1-6)

In Experiment 1-6, a destaticizing brush SA7 made by Kenei Co., Ltd. was used as a first destaticizing member. In Experiment 1-6, the volume resistivity of the destaticizing member on the upstream side was $1.0\times10^{+2}$ [Ωcm]. In addition, in Experiment 1-6, a similar one to the destaticizing member on the upstream side in Experiment 1-1 was used as a destaticizing brush on the downstream side. Incidentally, in Experiment 1-6, in the destaticizing member on the upstream side, the tip of each bristle bundle was set at a position of +1 mm, and in the destaticizing member on the downstream side, the tip of each saw tooth was set at a position of 0 mm.

(Experiment 1-7)

In Experiment 1-7, a third destaticizing member was provided between the destaticizing member on the upstream side and the destaticizing member on the downstream side in Experiment 1-4. The third destaticizing member was configured and set in the same manner as the destaticizing member on the upstream side.

(Experiment 1-8)

In Experiment 1-8, the destaticizing member on the upstream side and the destaticizing member on the downstream side in Experiment 1-4 were replaced by each other. Therefore, the configuration of Experiment 1-8 corresponds to the configuration of Example 1.

(Comparative 1-1)

In Comparative 1-1, only the destaticizing member on the downstream side in Experiment 1-1 was disposed. That is, the configuration of Comparative 1-1 corresponds to the background-art configuration in which destaticizing is performed by only a Detack saw that is grounded.

(Comparative 1-2)

Comparative 1-2 had a configuration in which the tip position of the Detack saw was set at a position of 0 mm in Comparative 1-1.

(Comparative 1-3)

In Comparative 1-3, a similar configuration to the destaticizing member on the upstream side in Experiment 1-4 was used as a destaticizing member on the upstream side. In addition, in Comparative 1-3, one from another lot of products similar to the destaticizing member on the upstream side was used as a destaticizing member on the downstream side. In Comparative 1-3, the volume resistivity of the destaticizing member on the downstream side was $0.8\times10^{-1}$ [Ωcm]. In addition, the tip position of the destaticizing member on the downstream side was set at a position of 0 mm in the same manner as the destaticizing member on the downstream side in Experiment 1-6.

(Experimental Results of Experiments 1)

As shown in FIG. 7, poor separation caused by insufficient destaticizing occurred in Comparative 1-1 using only a Detack saw.

In Comparative 1-2, the tooth tip of the Detack saw was closer to the sheet S so that the destaticizing performance could be improved. Thus, poor separation caused by insufficient destaticizing was improved in comparison with Comparative 1-1. However, the image quality deteriorated in Comparative 1-2. It is considered that this was because sudden destaticizing was performed intensively at the tooth tip of the Detack saw whose volume resistivity was low, and destaticizing the sheet S was so uneven that the image quality deteriorated due to the destaticizing unevenness.

In addition, in Comparative 1-3, poor separation occurred in the same manner as in Comparative 1-1. It is inferred that due to a small difference in volume resistivity between the destaticizing member on the upstream side and the destaticizing member on the downstream side, destaticizing was rarely performed by the destaticizing member on the downstream side, resulting in insufficient destaticizing.

On the other hand, in Experiments 1-1 to 1-8, good results as to releasability and image quality could be obtained even in short-grain sheets that were not firm. In Experiments 1-1 to 1-8, there was a difference of at least one digit in volume resistivity between the destaticizing member on the upstream side and the destaticizing member on the downstream side, and destaticizing was performed stepwise, as compared with Comparative 1-2 in which sudden destaticizing was performed only by the Detack saw 6 on the downstream side. It is therefore considered that sudden destaticizing was suppressed to thereby avoid deterioration of image quality caused by destaticizing unevenness. In addition, in Experiments 1-1 to 1-8, destaticizing was performed stepwise by the destaticizing member on the downstream side after destaticizing was performed by the destaticizing member on the upstream side. Accordingly, even when a sheet S that was not firm was attracted by the photoreceptor PR and separated from the downstream guide 17, the electrostatic attraction of the photoreceptor PR could be reduced by the destaticizing member on the upstream side. Thus, after the sheet S approached the downstream guide 17, destaticizing was also performed by the destaticizing member on the downstream side. It is therefore considered that the releasability of the sheet S was also improved.

In Experiments 1-4, 1-7 and 1-8, especially good results could be obtained. In experiments 1-1 to 1-3 and 1-6, the value of the volume resistivity of the destaticizing member on the upstream side was higher than that in Experiment 1-4 and so on, and the destaticizing performance on the upstream side was comparatively low. It is therefore considered that the releasability was lower than in Experiment 1-4. Incidentally, in Experiment 1-5, the value of the volume resistivity itself was comparatively high, but the destaticizing member on the upstream side touched the sheet S all over the range in the width direction. Thus, it is considered that insufficient destaticizing did not occur in Experiment 1-5, as compared with Experiments 1-1 to 1-3 and 1-6.

In addition, in Experiment 1-1, the destaticizing member on the upstream side protruded inside the conveyance path of the sheet S in comparison with that in Experiment 1-2. Accordingly, in Experiment 1-1, it is considered that excessive destaticizing was performed to lower the image quality, as compared with Experiment 1-4 and so on. In addition, also in Experiment 1-5, it is considered that excessive destaticizing was performed because the destaticizing member on the upstream side touched the sheet S all over the range in the width direction.

Further, in Experiment 1-6, the material forming the destaticizing member on the downstream side was not SUS in Experiment 1-4 or the like, but the value of volume resistivity thereof was higher than that in Experiment 1-4 or the like. Thus, it is considered that a part where destaticizing was insufficient appeared to cause uneven destaticizing or so-called destaticizing unevenness to thereby lower the image quality.

(Experiments 2)

Next, description will be made about experiments as to the relationship among tip positions of a destaticizing member on the upstream side and a destaticizing member on the downstream side, paper jam, durability and image quality (density unevenness).

Experiments 2 were evaluated under a low-temperature and low-humidity environment of 12° C. and 18% RH using DocuPrint P450 made by Fuji Xerox Co., Ltd. An A3-size sheet made by Fuji Xerox Co., Ltd. was cut into A4-size sheets, which were used as sheets S as an example of short grain paper, in the same manner as in Experiments 1.

In Experiments 2, when the performance about paper jam was evaluated, paper jam of a sheet S that was wound around the photoreceptor PR was regarded as paper jam caused by poor destaticizing, and paper jam of a sheet S that was not wound around the photoreceptor PR but had been damaged in its tip was regarded as paper jam caused by collision. The performance about paper jam was evaluated by the number of sheets in which paper jam occurred when 1,000 sheets were fed. An evaluation of "⊕" was given when the number of sheets in which paper jam occurred was zero. An evaluation of "○" was given when the number of sheets in which paper jam occurred was not smaller than one but smaller than five. An evaluation of "Δ" was given when the number of sheets in which paper jam occurred was not smaller than five but smaller than twenty. An evaluation of "x" was given when the number of sheets in which paper jam occurred was not smaller than twenty.

In addition, in Experiments 2, in order to evaluate the durability, experiments about paper jam were performed again on the same conditions after 10,000 sheets were fed. The durability was evaluated by a difference between the number of sheets S in which paper jam occurred before 10,000 sheets were fed and the number of sheets in which paper jam occurred after 10,000 sheets were fed. An evaluation of "⊕" was given when the different in the number of sheets in which paper jam occurred was zero. An evaluation of "○" was given when the difference was not smaller than one but smaller than five. An evaluation of "Δ" was given when the difference was not smaller than five but smaller than twenty. An evaluation of "x" was given when the difference was not smaller than twenty.

Further, in Experiments 2, in order to evaluate the density unevenness, an image whose density was 30% in 1,200 dpi was printed, and the image quality was evaluated by black stripes appearing in the printed image. An image quality evaluation of "⊕" was given when no black stripe appeared. An image quality evaluation of "○" was given when the number of black stripes 1 to 2 mm wide was not larger than five. An image quality evaluation of "Δ" was given when the number of black stripes 1 to 2 mm wide was in a range of from five to ten. An image quality evaluation of "x" was given when the number of black stripes 1 to 2 mm wide was not smaller than ten or when a black strip at least 2 mm wide appeared.

FIG. 9 shows a table of conditions and results of Experiments 2.

(Experiment 2-1)

In FIG. 9, in Experiment 2-1, a configuration of a Detack saw 6 and a destaticizing brush 18-19 was used in the same manner as in Example 1. A metal plate of SUS304 similar to the destaticizing member on the downstream side in Experiment 1-1 or the like was used as a destaticizing member on the upstream side. On the other hand, amorphous fiber Type 30 made by Kenei Co., Ltd. was used as a destaticizing member on the downstream side.

In Experiment 2-1, the tip position of the destaticizing member on the upstream side was set at a position of −1 mm and the tip position of the destaticizing member on the downstream side was set at a position of +0.5 mm when "+" designates a case where the destaticizing member protrudes into the conveyance path with respect to the external surface of the downstream guide 17, and "−" designates a case where the destaticizing member is retracted inside the downstream guide 17.

(Experiment 2-2)

Experiment 2-2 was configured in the same manner as Experiment 2-1, except that the tip position of the destaticizing member on the downstream side was set at a position of +1.5 mm.

(Experiment 2-3)

Experiment 2-3 was configured in the same manner as Experiment 2-1, except that the tip position of the destaticizing member on the downstream side was set at a position of +5 mm.

(Experiment 2-4)

Experiment 2-4 was configured in the same manner as Experiment 2-1, except that the tip position of the destaticizing member on the downstream side was set at a position of +6 mm.

(Comparative 2-1)

In Comparative 2-1, only the destaticizing member on the upstream side in Experiment 2-1 was used, but no destaticizing member was disposed on the downstream side.

(Comparative 2-2)

In Comparative 2-2, only the destaticizing member on the downstream side in Experiment 2-3 was used, but no destaticizing member was disposed on the upstream side.

(Comparative 2-3)

Comparative 2-3 had a configuration in which the tip position of the destaticizing member on the upstream side was set at a position of +5 mm in Comparative 2-1.

(Comparative 2-4)

Comparative 2-4 had a configuration in which the tip position of the destaticizing member on the downstream side was set at a position of −1 mm in Experiment 2-1.

(Experimental Results of Experiments 2)

In Experiments 2-1 to 2-4, the Detack saw 6 on the upstream side destaticized a sheet S in a non-contact manner, but the destaticizing brush 18-19 on the downstream side destaticized the sheet S in a contact manner. Accordingly, as shown in FIG. 9, good evaluations were given as to paper jam caused by poor destaticizing, paper jam caused by collision, durability, and density unevenness. Incidentally, it is considered that in Experiment 2-4 the distance with which the destaticizing brush 18-19 on the downstream side protruded into the conveyance path was so long that the frequency of touch with the sheet S or the pressure at the time of the touch increased to thereby degrade the evaluations as to the paper jam caused by collision and the durability in comparison with Experiments 2-1 to 2-3.

In addition, from the result of Comparative 2-1, it is considered that destaticizing only by the Detack saw 6 on the upstream side was insufficient. Thus, it is considered that paper jam caused by poor destaticizing occurred. Particularly it is considered that when destaticizing was performed only by the Detack saw 6 in a non-contact manner, destaticizing performance was insufficient and density unevenness caused by uneven destaticizing occurred.

Further, from the result of Comparative 2-2, it is considered that destaticizing only by the destaticizing brush 18-19 on the downstream side was insufficient to generate paper jam caused by poor destaticizing or density unevenness.

In addition, from the result of Comparative 2-3, when the Detack saw 6 was allowed to protrude, the destaticizing performance was enhanced to improve the paper jam caused by poor destaticizing, but the sheet S collided with Detack saw 6 easily to deteriorate the paper jam caused by collision.

Further, from the result of Comparative 2-4, when the destaticizing brush 18-19 on the downstream side was retracted to perform destaticizing in a non-contact manner with the sheet S, the destaticizing performance was lowered to deteriorate the paper jam caused by poor destaticizing.

(Modifications)

Although Example of the invention has been described above in details, the invention is not limited to the Example but various changes may be made thereon without departing from the spirit and scope of the invention stated in the claims. Modifications (H01) to (H08) of the invention will be shown below by way of example.

(H01) Although a printer as an example of an image forming apparatus was shown in the aforementioned Example, the invention is not limited thereto, but it may be applied to another image forming apparatus such as a copying machine or a facsimile machine. In addition, the invention is not limited to a single-color image forming apparatus, but it may be applied to a multi-color image forming apparatus. Therefore, the photoreceptor PR as an example of an image holder was shown by way of example, but the invention is not limited thereto. For example, the invention may be applied to an image forming apparatus provided with an intermediate transfer belt, an intermediate transfer drum or the like as an example of an image holder.

(H02) The number of destaticizing members is not limited to two in the aforementioned Example, but it may be set at three or more as shown in Experiments. In addition, the positions of the Detack saw 6 and the destaticizing brush 18-19 may be replaced by each other between the upstream side and the downstream side. However, it is considered that it is preferable that the destaticizing brush 18-19 is disposed on the upstream side in order to start destaticizing earlier when a sheet S that is not firm passes a position far from the downstream guide 17.

(H03) The specific numerical values shown in the aforementioned Example by way of example may be changed suitably in accordance with designs, specifications, etc.

(H04) Although the configuration in which the destaticizing brush 18-19 is brought into contact with the Detack saw 6 to thereby ground them at a single place of the grounding portion 6*c* of the Detack saw 6 was shown in the aforementioned Example, the invention is not limited thereto. For example, the configuration may be changed in such a manner that a grounding portion is also provided in the destaticizing brush 18-19 so as to be grounded independently. In this case, the destaticizing brush 18-19 may be disposed not in contact with the Detack saw 6 but at a distance therefrom.

(H05) Although the configuration in which all the bristle bundles 19 are held using a single aluminum tape 18 was shown in the aforementioned Example by way of example, the invention is not limited thereto. For example, the configuration may be changed in such a manner that the aluminum tape is divided into a front portion, a center portion and a rear portion, and those portions are brought into contact with the Detack saw 6 individually.

(H06) Although the bristle bundles 19 are disposed in every second positions corresponding to the tooth tips of the Detack saw 6 was shown in the aforementioned Example byway of example, the invention is not limited thereto. The configuration may be changed in such a manner that the bristle bundles 19 may be disposed more densely than the tooth tips of the Detack saw 6 or in every third positions. Alternatively, the bristle bundles 19 may be disposed independently of the intervals of the tooth tips of the Detack saw 6.

(H07) Although the configuration in which the bristle bundles 19 are supported inside the downstream guide 17 was shown in the aforementioned Example by way of example, the invention is not limited thereto. For example, the configuration may be changed in such a manner that the bristle bundles 19 are supported on the external surface of the downstream guide 17.

(H08) Although it is preferable in the aforementioned Example that the destaticizing members 6 and 18-19 are grounded, the configuration may be changed in such a manner that a voltage for destaticizing is applied thereto.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A destaticizing device comprising:

a first destaticizing member that is disposed at a downstream side in a conveyance direction of a medium relatively to a transfer area where an image held in a surface of an image holder is transferred to the medium, the first destaticizing member being grounded and destaticizing the medium;

a second destaticizing member that is disposed adjacent to the first destaticizing member with respect to the conveyance direction of the medium, the second destaticizing member being grounded and destaticizing the medium; and a protective member that is disposed at an inner side of a conveyance path for the medium relatively to a medium-side end portion of the first destaticizing member, the protective member comprising (1) a protection portion that protects the end portion of the first destaticizing member so that the first destaticizing member does not extend outside of the protective member and (2) a support portion that supports the protection portion and also supports the first destaticizing member, wherein the second destaticizing member is supported on the support portion.

2. The destaticizing device according to claim 1, wherein:

the first destaticizing member is made from metal and an end portion of the first destaticizing member opposed to the medium is formed into a saw-toothed shape; and the second destaticizing member comprises a plurality of conductive bristles.

3. The destaticizing device according to claim 1, wherein:

a medium-side end portion of the second destaticizing member protrudes into a conveyance path for the medium relatively to a medium-side end portion of the first destaticizing member.

4. The destaticizing device according to claim 1, further comprising:

a grounding portion that is provided in the first destaticizing member and grounded; wherein:

the second destaticizing member that has been in contact with the first destaticizing member and grounded is supported on the support portion.

5. An image forming apparatus comprising:

an image holder having a surface at which a visible image is formed;

a transfer device that transfers the visible image at the surface of the image holder to a medium;

the destaticizing device according to claim 1, the destaticizing device destaticizing the medium to which the visible image has been transferred, so that the medium is separated from the image holder; and a fixing device that fixes the visible image transferred to the medium.

6. A destaticizing device comprising:

a first destaticizing member that is disposed at a downstream side in a conveyance direction of a medium relatively to a transfer area where an image held in a surface of an image holder is transferred to the medium, the first destaticizing member destaticizing the medium; and a second destaticizing member that is disposed adjacent to the first destaticizing member with respect to the conveyance direction of the medium, the second destaticizing member being made from a material whose volume resistivity is different from that of the first destaticizing member by at least one digit under an environment of 10° C. and 13% RH, the second destaticizing member destaticizing the medium.

7. The destaticizing device according to claim 6, wherein:

the second destaticizing member is disposed at an upstream side in the conveyance direction of the medium, and the second destaticizing member is higher in volume resistivity than the first destaticizing member.

8. The destaticizing device according to claim 6, wherein:

the second destaticizing member is disposed so that a medium-side end portion of the second destaticizing member protrudes into the conveyance path for the medium relatively to a medium-side end portion of the first destaticizing member.

9. The destaticizing device according to claim 6, wherein:

the first destaticizing member and the second destaticizing member are grounded.

10. An image forming apparatus comprising:

an image holder having a surface at which a visible image is formed;

a transfer device that transfers the visible image at the surface of the image holder to a medium;

the destaticizing device according to claim 6, the destaticizing device destaticizing the medium to which the visible image has been transferred, so that the medium is separated from the image holder; and a fixing device that fixes the visible image transferred to the medium.

11. A destaticizing device comprising:

a guide member that is disposed at a downstream side in a conveyance direction of a medium relatively to a transfer area where an image held in a surface of an image holder is transferred to the medium, the guide member guiding the medium;

a first destaticizing member whose distal end is disposed outside of a conveyance path for the medium with respect to a guide plane on which the guide member guides the medium so that the distal end of the first destaticizing member does not touch the medium when the medium is traveling on the conveyance path, the first destaticizing member destaticizing the medium; and a second destaticizing member whose distal end is disposed within the conveyance path for the medium with respect to the guide plane on which the guide member guides the medium so that the distal end of the second destaticizing member touches the medium when the medium is traveling on the conveyance path, the second destaticizing member being designed to be able to be elastically deformed when the second destaticizing member touches the medium, the second destaticizing member destaticizing the medium and being disposed at the downstream side of the first destaticizing member.

12. The destaticizing device according to claim 11, wherein:

the second destaticizing member comprises a plurality of conductive bristles.

13. The destaticizing device according to claim 11, wherein:

a distance with which a medium-side end portion of the second destaticizing member protrudes into the conveyance path for the medium with respect to the guide plane is set to be not longer than 5 mm.

14. An image forming apparatus comprising:

an image holder having a surface at which a visible image is formed;

a transfer device that transfers the visible image at the surface of the image holder to a medium;

the destaticizing device according to claim 11, the destaticizing device destaticizing the medium to which the visible image has been transferred, so that the medium is separated from the image holder; and a fixing device that fixes the visible image transferred to the medium.

* * * * *